US005766085A

United States Patent [19]

Knez

[11] Patent Number: 5,766,085

[45] Date of Patent: Jun. 16, 1998

[54] PROPULSION ASSEMBLY

[75] Inventor: Jordan Knez, Halmstad, Sweden

[73] Assignee: J. Knez AB, Skallebackavägen, Sweden

[21] Appl. No.: 784,188

[22] Filed: Jan. 15, 1997

[30] Foreign Application Priority Data

Jan. 16, 1996 [SE] Sweden ..... 9600158

[51] Int. Cl.[6] ..... A63B 57/00

[52] U.S. Cl. ..... 473/132; 124/56

[58] Field of Search ..... 473/131, 132, 473/135, 136; 124/6, 78, 56, 59, 70, 71, 73, 76

[56] References Cited

U.S. PATENT DOCUMENTS

| | | | |
|---|---|---|---|
| 3,294,402 | 12/1966 | Scott | 473/136 |
| 3,911,888 | 10/1975 | Horvath | 124/56 |
| 4,299,383 | 11/1981 | Yuasa | 124/78 |
| 4,559,918 | 12/1985 | Ballerin et al. | 124/78 |
| 4,981,299 | 1/1991 | Petrillo | 473/136 |
| 5,413,085 | 5/1995 | Kraeft | 124/56 |

*Primary Examiner*—Steven B. Wong

*Attorney, Agent, or Firm*—Antonelli, Terry, Stout, & Kraus, LLP

[57] ABSTRACT

An apparatus for the transport of spheroidal objects, for example golf balls, with the aid of an air current generated in a conduit system by a fan unit, from an infeed point (13) to a number of stations in the form of sites of use (teeing-off sites), storage points (magazines, automatic dispensers), and so on. An infeed tube (14) is provided for infeed of the spheroidal objects into the conduit system and discharges the objects at a shunting device (16) which engages the objects in sequence one after another and moves the objects along the infeed tube (14) in a direction towards a conduit in the conduit system from a receptacle point (13). A second shunting device (18) is provided between the receptacle point (13) and the shunting device (16) for urging the spheroidal objects in the opposite direction from the infeed tube (14) towards the receptacle point (13) in the event that the objects are disposed on one another.

10 Claims, 2 Drawing Sheets

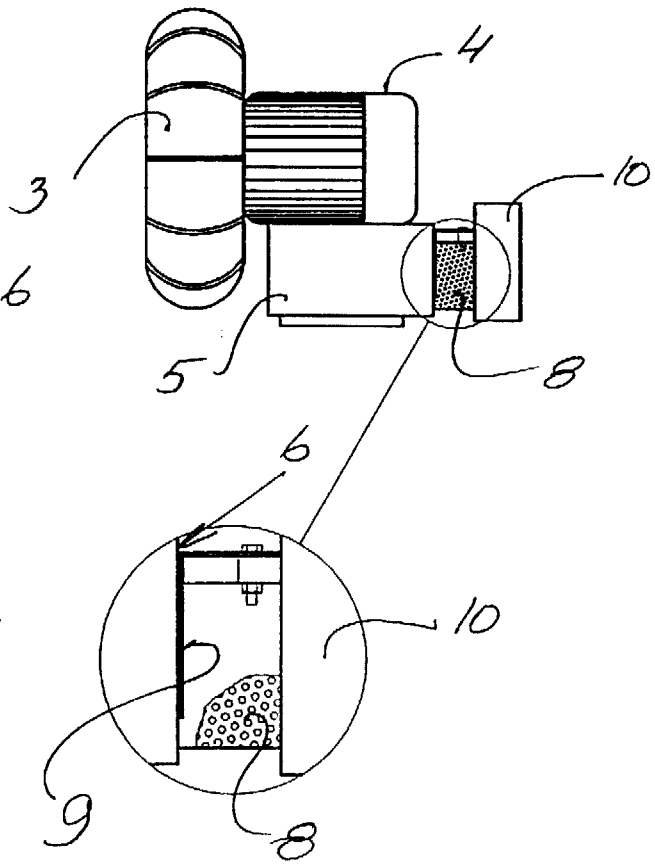
Fig 6
Fig 7
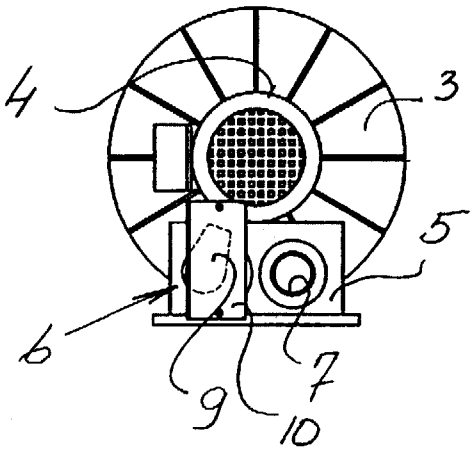
Fig 5

PROPULSION ASSEMBLY

BACKGROUND OF THE INVENTION

The present invention relates to an apparatus for transport of spherical objects, and golf balls.

In particular at golf driving ranges for driving practice, wishes have been increasingly expressed for the transport of the golf balls using air in conduit systems between different stations, with the purpose of eliminating manual handling of the golf balls as far as is possible. For example, it is desirable to be able to transport the golf balls from a washing plant to storing locations of different types or to sites of use, for example automatic golf ball dispensers at a number of tees or direct to smaller storage or magazines at the site of the tee proper, which may be equipped with an automatic pegging mechanism. The transport distance or distances may vary to a relatively large extent even in the same conduit system, and the conduit system may include one or more switches for transport of the golf balls to a plurality of different places using the same propulsion assembly which generator an air current is generated by means of a fan of the thrust propeller or turbine type.

The object forming the basis of the present invention is to satisfy the above-outlined wishes.

SUMMARY OF THE INVENTION

An apparatus according to the present invention makes possible the infeed of spheroidal objects such as golf balls into a conduit system for transport of the objects to different stations at extremely high capacity and extremely high speed. This is of major importance in installations with a relatively large number of stations in the form of, for example, automatic golf ball dispensers, teeing-off points with golf ball magazines, and possibly automatic pegging machines. An apparatus according to the present invention has proved to permit the infeed of as large a number of golf balls as 400 per minute and more. As a result of the apparatus according to the present invention, there is moreover attained an extremely important valve function, in that the objects located in the infeed tube serve as valves, preventing the access of extraneous air into the system. The apparatus according to the present invention further permits regulation of the air infeed to the assembly generating the air current for governing the air current in relation to the desired transport distance.

BRIEF DESCRIPTION OF THE DRAWINGS

The present invention will now be described in greater detail hereinbelow, with reference to the accompanying Drawings. FIG. 5 shows a view from one end of a part of the apparatus of FIG. 1. FIG. 6 is a side elevation of the part illustrated in FIG. 5. FIG. 7 shows, on a larger scale, a part of the apparatus of FIG. 6.

Figures 1, 2, 3, 4:
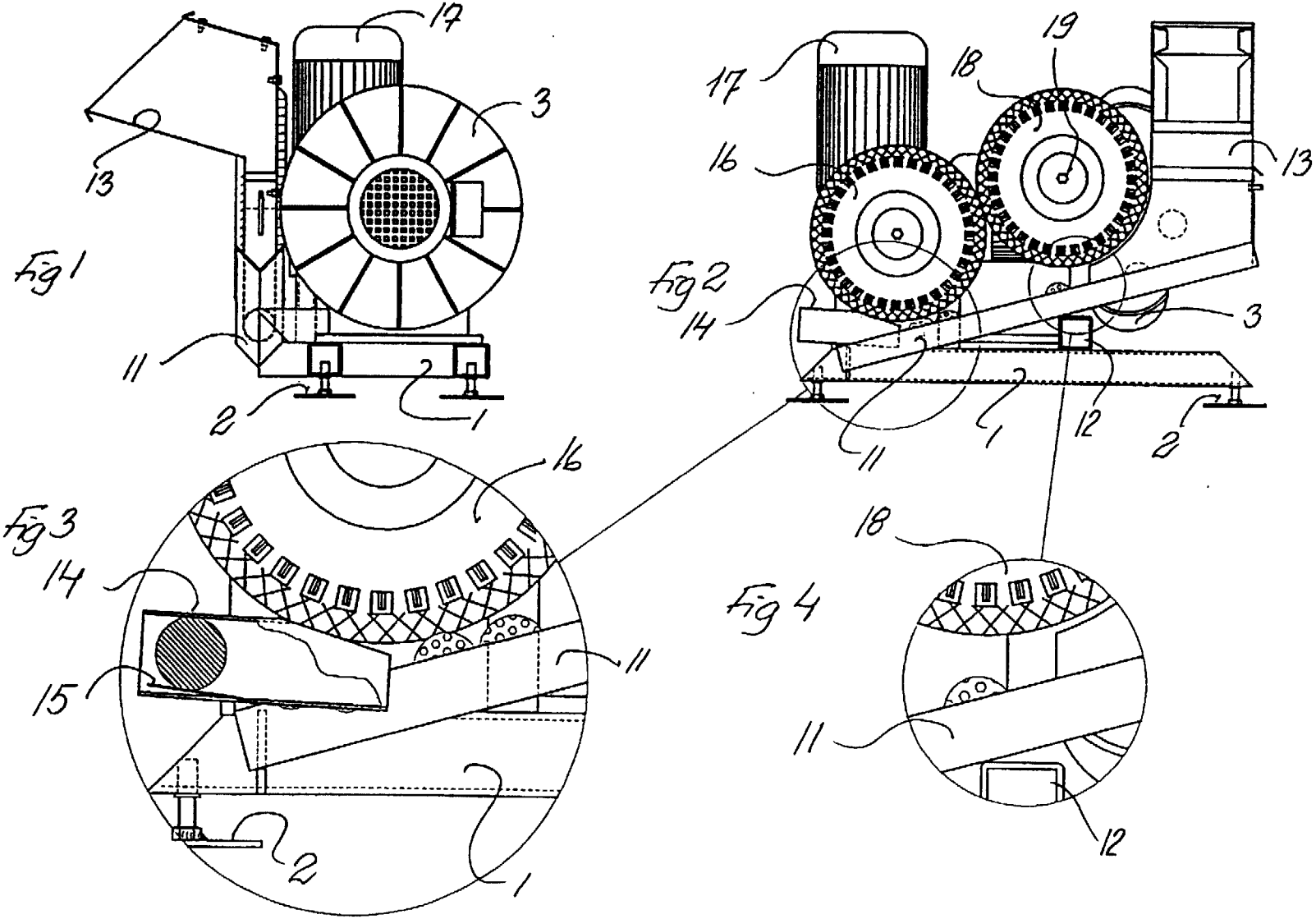
FIG. 1 shows a view from one end of one embodiment of an apparatus according to the present invention.
FIG. 2 is a side elevation of the apparatus shown in FIG. 1.
FIG. 3 shows, on a larger scale, a part of the apparatus of FIG. 2.
FIG. 4 shows, on a larger scale, another part of the apparatus of FIG. 2.

One embodiment of an apparatus according to the present invention includes a frame 1 which is constructed from a number of square tubes and other frame parts, such as flat irons, L angle irons and so on, and which has a four adjustable feet 2. On the frame 1, there is mounted a fan unit which is shown in greater detail in FIGS. 5–7 and which comprises a fan 3, which is driven by an electric motor 4 and which may be of the turbine type or other suitable type. The electric motor 4 is mounted on a box 5 with an air inlet 6 and an air outlet 7. The air inlet 6 is shown in greater detail in FIG. 7. The air outlet 7 is coupled to a conduit system (not shown in detail) for transport of golf balls in an air current generated by means of the fan 3 to a number of stations in the form of sites of use, such as teeing-off sites, storage places, such as magazines and automatic dispensers etc. The conduit system may also include a number of switches for transporting the golf balls to the desired stations via different conduits. The conduits are advantageously of plastic and ideally of the same type as those employed in the water, heating and sanitation industry.

as seen in FIG. 7, the air inlet aperture 6 is covered by means of a perforated hood 8. An adjustable throttle 9 is disposed within the hood 8 and is coupled to a throttle motor 10 for regulating the intake aperture proper as required, in other words in accordance with the force which is required in the outgoing air current depending upon the distance or distances to the intended station or stations. As a result of this regulation possibility, the noise level in the installation as a whole can be regulated to as low a level as possible.

On the frame 1, there is further mounted an assembly for the infeed of the golf balls into the conduit system. The golf balls illustrated and exemplified in the Drawing figures have not been given a reference numeral, since they clearly and unambiguously differ from the components included in the assembly. At the upper end of a ball chute 11 which rests on a transverse square tube 12 of the frame 1, there is disposed an infeed hopper 13 to which golf balls are fed from a store or direct from a machine or installation for washing and cleaning of the golf balls. The slope of the ball chute 11 implies that the golf balls roll on the chute down towards its lower end. The golf ball chute 11 is V-shaped and the golf balls roll in the chute a relatively large distance up on the walls of the chute so that a space a formed beneath the golf balls. This space facilitates the run-off of water and any possible dirt. At the lower end of the golf ball chute 11, there is disposed an infeed tube 14 whose inlet edge located most proximal the chute 11 is disposed flush with or beneath the underside of golf balls located in the chute 11 so that the golf balls may roll into the infeed tube 14. The opposite end of the infeed tube 14 in relation to the chute 11 is connected to the conduit system so that golf balls in the infeed tube 14 may be fed into the conduit system and the air current located therein for transport to one of the stations. Arrest means 15 are disposed in the infeed tube 14 and, in the present embodiment, consist of a leaf spring. The leaf spring 15 urges the golf ball against the opposing inner side of the infeed tube 14 and prevents the golf ball from unintentionally departing from the infeed tube 14. The golf ball in the infeed tube 14 will thus serve as a valve against the suction intake of air into the conduit system via the infeed tube 14. As is apparent from FIG. 3, a plurality of golf balls in sequence one after another may be located in the infeed tube 14 at the same time.

In order to ensure the infeed of golf balls into the infeed tube 14, past the arrest means 15 and further into the conduit system from the ball chute 11, there is provided, above the ball chute 11 and the infeed tube 14, a wheel 16 which has a friction surface for engagement with the golf balls in the chute 11 and in the infeed tube 14. The friction surface of the wheel 16 may consist of a tyre with suitable tread pattern for achieving a high degree of friction between the surface and the golf balls. The wheel 16 is driven by an electric motor 17 by the intermediary of a suitable gear or transmission. The wheel 16 is driven in such a direction that the periphery or friction surface moves from the chute 11 towards the infeed tube 14, whereby the golf balls will be fed into the infeed tube 14 and urged past the spring 15 into the conduit system. In order for a golf ball to pass the spring 15, it is thus necessary that one or more golf balls be located in sequence one after another in the infeed tube 14, and that an additional golf ball be urged into the infeed tube and shunt the other golf balls ahead of it past the spring 15 into the conduit system.

Between the wheel 16 and the infeed hopper 13, there is disposed a further wheel 18 which is journalled for rotation about a shaft 19 by the intermediary of a suitable journal. The wheel 18 displays a suitable friction surface, for example a tyre tread surface. The friction surface on the wheel 18 is in engagement with the friction surface on the wheel 16 and will thus rotate simultaneously with the wheel 16, which may thereby be considered as driving the wheel 18 in the opposite direction in relation to the wheel 16. The friction surface on the wheel 18 will thus move in a direction from the infeed tube 14 towards the hopper 13, which implies that golf balls in the lower end of the hopper 13 above the chute 11 will be activated by the tyre tread surface and displaced in a direction into the hopper 13. This will prevent the golf balls from climbing up on one another in the chute 11 by being oriented with the aid of the wheel 18 so as to roll in sequence after one another in the chute 11.

The walls of the chute 11 directly beneath the hopper 13 may be considered to be extended up towards the lower end of the hopper and are adapted to the periphery of the wheel 18 in the proximity thereof. By such means, the sequence of golf balls in the chute 11 will be guaranteed, which is of major importance since it is desirable to achieve a high infeed capacity. On testing of the apparatus according to the present invention, it has proved possible to achieve infeed capacities of several hundred golf balls a minute, for example 400 golf balls a minute.

Naturally, the present invention is not restricted to the embodiment described in the foregoing, but may be modified and altered in many ways without departing from the spirit and scope of the inventive concept.

I claim:

1. An apparatus for the transport of spheroidal objects, with the aid of an air current generated in a conduit system by a fan unit, from a receptacle point (13) to a number of stations, said apparatus comprising:

an infeed tube (14) for infeed of the objects into the conduit system;

a shunting device (16) for engagement with the objects in sequence one after another to move the objects along the infeed tube (14) in a direction towards a conduit in the conduit systems; means (18) between the receptacle point (13) and the shunting device (16) for urging the objects in the opposite direction from the infeed tube (14) towards the receptacle point (13) in the event that the objects are disposed on one another.

2. The apparatus as claimed in claim 1, wherein said shunting device comprises a first wheel (16) having a first friction surface for engagement with the objects, and a motor for driving said first wheel to rotate said first friction surface towards said infeed tube (14) and to move objects located in engagement therewith.

3. The apparatus as claimed in claim 2, wherein said urging means comprise a second wheel (18) having a second friction surface for engagement with the objects when the objects are disposed on one another, said second wheel being in engagement with said first wheel (16) to be rotated thereby so as to urge the objects in a direction from said infeed tube (14) towards said receptacle point (13).

4. The apparatus as claimed in claim 2, wherein:

said infeed tube (14) includes a chamber for holding a plurality of the objects;

said apparatus further comprises arrest means (15) in an outlet from said chamber; and when there are one or more objects in the chamber, the distance between the periphery of the first wheel (16) and the position in the chamber of the most proximal object is smaller than the diameter of the object.

5. The apparatus as claimed in claim 4, wherein said arrest means are self-yielding and may be overcome by urging of objects in the chamber past said arrest means by said first wheel (16).

6. The apparatus as claimed in claim 3, wherein each of the first friction surface and the second friction surface has a tread pattern to facilitate engagement with the objects.

7. The apparatus as claimed in claim 1, further comprising a fan unit for generating an air currents said fan unit having a suction intake aperture (6) with a throttle (9), and a motor (10) for adjusting said throttle to restrict the suction intake aperture.

8. The apparatus as claimed in claim 7, wherein said fan unit further has a perforated hood (8) mounted over said throttle (9) and the suction intake aperture (6).

9. The apparatus as claimed in claim 1, wherein said infeed tube (14) has an opening disposed beneath said first wheel (16) and a chute (11) for receiving the objects from said receptacle point and permitting the objects to roll into the infeed tube (14) after engagement with said first friction surface.

10. The apparatus as claimed in claim 9, wherein said chute (11) is V-shaped and has a tip beneath the inlet opening of said infeed tube (14) for run-off of water and dirt.

* * * * *